US007223324B2

(12) United States Patent
Dufresne

(10) Patent No.: US 7,223,324 B2
(45) Date of Patent: May 29, 2007

(54) CAPPING BOARD WITH SEPARATING WALLS

(75) Inventor: Robert P. Dufresne, St-Bruno (CA)

(73) Assignee: Pultrusion Technique Inc., St-Bruno, Québec (CA)

( * ) Notice: Subject to any disclaimer, the term of this patent is extended or adjusted under 35 U.S.C. 154(b) by 278 days.

(21) Appl. No.: 10/996,366

(22) Filed: Nov. 26, 2004

(65) Prior Publication Data

US 2005/0284753 A1 Dec. 29, 2005

(51) Int. Cl.
*C25B 9/04* (2006.01)

(52) U.S. Cl. ..... 204/279; 204/267; 204/278.5; 204/281; 204/286.1; 204/288.1; 204/288.2; 204/297.01

(58) Field of Classification Search ..... 204/267, 204/278.5, 279, 281, 286.1, 288.1, 288.2, 204/297.01

See application file for complete search history.

(56) References Cited

U.S. PATENT DOCUMENTS 3,697,407 A 10/1972 Lacagnina et al.
3,929,614 A * 12/1975 Hidohira ..... 204/242
4,213,842 A 7/1980 Dufresne
4,479,863 A * 10/1984 Honey et al. ..... 204/279
5,645,701 A 7/1997 Dufresne et al.
6,342,136 B1 1/2002 Virtanen et al.
2003/0066759 A1 * 4/2003 Hardee et al. ..... 205/565

* cited by examiner

*Primary Examiner*—Bruce F. Bell
(74) *Attorney, Agent, or Firm*—ROBIC

(57) ABSTRACT

Disclosed in a capping board for use to support hanging legs of anodes and cathodes within adjacent electrolytic cells. This capping board has a main body having a bottom surface shaped to fit onto upper edges of the adjacent cells, and a top surface. A first set of spaced part insulating blocks project from the top surface. This first set of blocks extends in line all over the length of the capping board on one side of the main body. A second set of spaced part insulating blocks also projects from the top surface. This second set of blocks also extends in line all over the length of the capping board at a given lateral distance from the first set of blocks. Thus, the two sets of blocks form two rows that together define a central path on the top surface. Each of the blocks has a recess forming an upwardly and laterally opening compartment to receive and support one of the hanging legs of the anodes and cathodes. Advantageously, a plurality of separating walls project upwardly from the top surface of the main body so as to extend transversally across the central path and dividing this central path into a plurality of separate segments in which separate contact bars may respectively be positioned. Due to such a division of the contact bars into separate segments, any short circuit that occurs by accident is no more "transferred" to all the electrodes of the cells. It is actually transmitted only to the few electrodes in contact with the segment(s) to which is connected the electrode that is at the origin of the trouble.

8 Claims, 1 Drawing Sheet

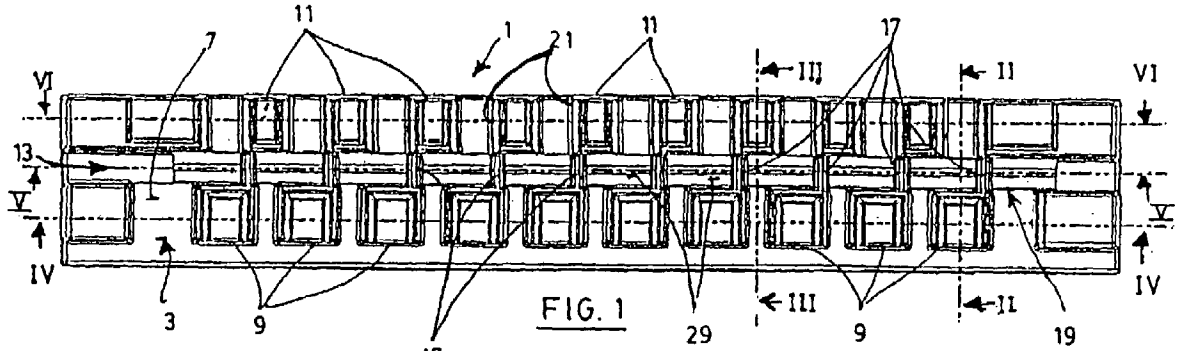
FIG. 1
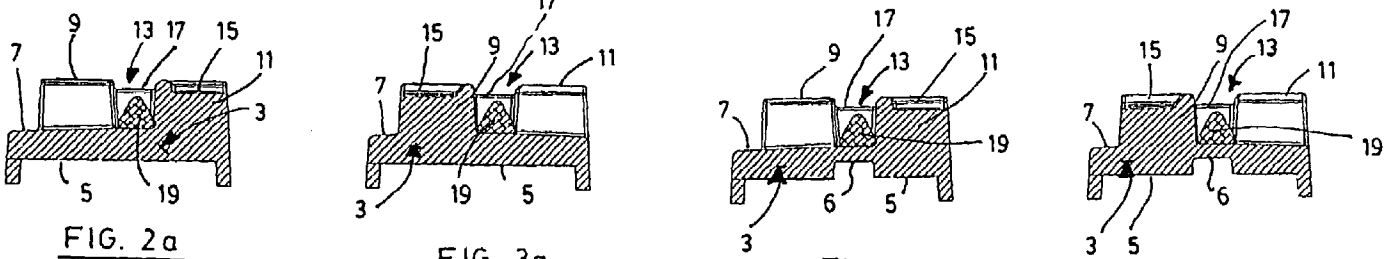
FIG. 2a
FIG. 2b
FIG. 3a
FIG. 3b
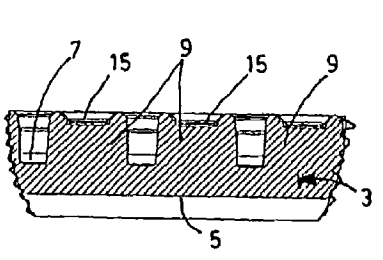
FIG. 4
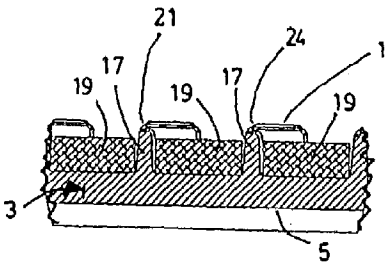
FIG. 5
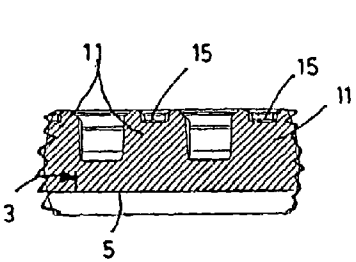
FIG. 6

CAPPING BOARD WITH SEPARATING WALLS

BACKGROUND OF THE INVENTION a) Field of the Invention

The present invention relates to an improved capping board for use to support hanging legs of anodes and cathodes extending within adjacent electrolytic cells.

b) Brief Description of the Prior Art

In the hydrometallurgical industry, it is of common practice to refine metal by electrolysis in electrolytic cells especially designed for this purpose. The metals to be refined are usually conventional metals like copper, zinc, nickel or cadmium, or precious metals like silver, platinum or gold, and others.

It is also of common practice to use metal plates as anodes or cathodes or both. These metal plates weight several hundred pounds. Usually, the metal to be refined, or the metal used to carry the electric current, is in the form of plates of a given thickness, which are provided at their upper end with two laterally extending projections. Such projections facilitate gripping, handling and hanging of the plates on lateral sidewalls of the cells.

In use, the plates which, as aforesaid, can each weight several hundred pounds, are immersed into the cells in parallel relationship and are used as anodes, cathodes or both, depending on the affinity of the metal being refined.

In order to have the electrodes positioned at the exact place, it is of common practice to place a member called "capping board", onto the top surface of each lateral sidewall of the cells. These capping boards are used to position the plates with respect to each other. They are also used as electric insulators between adjacent cells and/or each electrodes and/or the ground.

In practice, the capping boards are used not only as supports to position the electrodes, but also as supports to avoid damage to the masonry or concrete forming the lateral side walls of the cells during the insertion and removal of the heaving electrodes.

As examples of such capping boards and the way they can be manufactured, reference can be made to U.S. Pat. No. 4,213,842 issued on Jul. 22, 1980 and Canadian patent No. 1,102,737 issued on Jun. 9, 1981 both in the name of Jean L. DUFRESNE. Reference can also be made to the U.S. Pat. No. 5,645,701 issued on Jul. 8, 1997 and Canadian laid-open patent application No. 2,171,412 filed on Mar. 8, 1996 both in the names of Jean L. DUFRESNE and the present inventor, namely, Robert P. DUFRESNE. Reference can further be made to U.S. patent application Ser. No. 10/725,548 filed on Dec. 3, 2003 and to its Canadian counterpart in the name of the present inventor.

As other examples of such capping boards, reference can also be made to U.S. Pat. No. 3,697,404 issued on Oct. 10, 1972 to Peter M. PAIGE and to U.S. Pat. No. 6,342,136 issued on Jan. 29, 2002 to OUTOKUMPU OY.

As aforesaid, the above mentioned insulating capping boards are used to hold the electrodes at very precise positions. They are also used in combination with electrically conductive contact bars whose purpose is to allow electrical connection between the ends of the anodes and cathodes located in the adjacent cells. Thus, the combined use of capping boards and contact bars have the particularity of allowing insulation and distribution of electric current at the same time.

To achieve proper electrical contact with the contact bar, the plates forming the electrodes are provided with support hanging legs externally projecting on their opposite upper ends. Only one side of the legs of each plate is in contact with a contact bar on one side of the cell where it is located. The other leg of the same plate is held onto the capping board located on the opposite side of the cell in such a way as to be insulated. Thus, the capping board per se plays the role of an insulator and has, for this purpose, to be made of material that is insulating.

So far, it has been of common practice to use contact bars of usually triangular round or rectangular of cross-section or of other cross sectional shape, that extends over the full length of a central path made in the corresponding capping board in order to connect altogether all the anodes of one cell to all the cathodes of the adjacent cell.

The problem with such "lengthy" contact bars is that whenever a short circuit occurs, it "affects" all the electrodes which are connected altogether. Then all the electricity is trying to pass by this said short circuit, which induce very high electric current densities at some specific places and induce very low current density at other places.

These high electric current densities create refined copper of very poor quality, which undesirable. Also, this short circuit creates an increase in temperature.

Such causes the temperature of all the metal plates forming the anodes and cathodes to increase and such an increase may be transmitted to the insulating capping-boards, which may then be subject to deformation. Such deformation is unacceptable since it may generate other short circuits that may propagate from one cell to another cell and which may result in the production of a refined metal with major impurity and defects.

SUMMARY OF THE INVENTION

It has now been discovered that the above mentioned problem encountered with the conventional contact bars in the case of short circuits, may be solved when the contact bars are "divided" into a plurality of separate segments on which only a short number of the anodes and cathodes are connected.

Due to such a division of the contact bars into separate segments, any short circuit that occurs by accident, all the electricity of the cell is no more "transferred" to all the electrodes of the cells. It is actually transmitted only to the few electrodes in contact with the segment(s) to which is connected the electrode that is at the origin of the trouble.

Thus, the invention is directed to an improved capping board for use to support hanging legs of anodes and cathodes within adjacent electrolytic cells and to the regulation of the distribution of the electric current density, which capping board has a given length and comprises:

- a main body having a bottom surface shaped to fit onto upper edges of the adjacent cells, and a top surface;
- a first set of spaced part insulating blocks projecting from the top surface, this first set of blocks extending in line all over the length of the capping board on one side of the main body; and
- a second set of spaced part insulating blocks projecting from the top surface, this second set of blocks extending also in line all over the length of the capping board at a given lateral distance from the first set of blocks;
- the two sets of blocks forming two rows that together define a central path on said top surface;
- each of said blocks having a recess forming an upwardly and laterally opening compartment to receive and support one of the hanging legs of the anodes and cathodes.

The improvement essentially lies in that the capping board also comprises:

a plurality of separating walls projecting upwardly from its top surface, the separating walls extending transversally across the central path and dividing this central path into a plurality of separate segments in which separate contact bars may respectively be positioned.

In practice, the separating walls are positioned in such a manner that each of the corresponding separate segment be sized to allow connection of only one anode located in one of the adjacent cells to only one cathode located in another one of the adjacent cells. However, the walls could be positioned so that each of the corresponding segments be sized to allow connection of two, three or more adjacent anodes located in one of the adjacent cells to two, three or more adjacent cathodes located in another one of adjacent cells.

In all cases, it is important that all the electrodes of one cell be not in direct contact with all the electrodes of the adjacent cell.

The invention and its advantages will be better understood upon reading the following non-restrictive description of a preferred embodiment thereof, made with reference to the accompanying drawings.

BRIEF DESCRIPTION OF THE DRAWINGS

In the accompanying drawings:

FIG. 1 is a top plan view of a capping board according to a preferred embodiment of the invention;

FIGS. 2*a* and 3*a* are transversal cross-sectional views taken along lines II—II and III—III, respectively, of the capping board shown in FIG. 1;

FIGS. 2*b* and 3*b* are transversal cross-sectional views taken along the same lines II—II and III—III, respectively, of a variant of the capping board shown in FIG. 1, the difference lying in the presence of a longitudinal notch made in the bottom surface of the main body of the capping board;

FIG. 4 is a longitudinal cross-sectional view taken along line IV—IV, of a portion of the capping board shown in FIG. 1;

FIG. 5 is a longitudinal cross-sectional view taken along line V—V, of a portion of the capping board shown in FIG. 1; and FIG. 6 is a longitudinal cross-sectional view taken along line VI—VI, of a portion of the capping board shown in FIG. 1.

DETAILED DESCRIPTION OF THE INVENTION

The capping board 1 according to the invention as shown in the accompanying drawings, is intended to be used to support hanging legs of anodes and cathodes within adjacent electrolytic cells.

This capping board 1 of a given length and comprises a main body 3 having a bottom surface 5 that is shaped to fit onto upper edges of the adjacent cells. This bottom surface 5 may comprise a central notch 6 (see FIGS. 2*b* and 3*b*). The main body 3 of the capping board also has a top surface 7 from which project a first set of spaced part insulating blocks 9 that extend in line all over the length of the capping board on one side of the main body. A second set of spaced part insulating blocks 11 also project from the top surface. This second set of blocks extends also in line all over the length of the capping board at a given lateral distance from the first set of blocks 9.

As is shown, the two sets of blocks 9, 11 form two rows that together define a central path 13 on the top surface. As is also shown, each block has a recess 15 forming an upwardly and laterally opening compartment to receive and support one of the hanging legs of the anodes and cathodes.

This basic structure is already known (see FIGS. 8 to 16 of U.S. patent application Ser. No. 10/725,548 mentioned hereinabove, in the name of the same inventor). Accordingly, it does not need to be further described.

As a matter of fact, the present invention essentially lies in that the capping board 1 also comprises a plurality of separating walls 17 projecting upwardly from its top surface 5 within the central path 13. As is shown, these separating walls extend transversally across the central path 13 and divide this central path into a plurality of separate segments in which separate contact bars 19 may respectively be positioned.

As is shown, the blocks 9 of the first set are in alternate position relative to the blocks 13 of the second one, whereby an anode or cathode having one leg held within a recess 15 made on top of one of the insulating blocks on one side of a cell may have its opposite leg that extends between to adjacent insulating blocks of another identical capping board located on the other side of the cell and thus bears onto the separate contact bar 19 that is positioned in the corresponding segment of the central path of the other capping board.

In the illustrated embodiment, each of the separate segment extends from one side 21 of one of the blocks of one of said set of blocks (see FIGS. 1 and 5) up to the same side of the next block of the same set of blocks, so as to allow electrical connection of the hanging legs of only one anode to one cathode. However, such is only optional and the separating walls 17 could be positioned to define separate segments extending over a plurality of blocks.

In all cases, the only "actual" requirement is that, contrary to what has been done so far, use be not made of a single contact bar 19 extending over the full length of the central path 13. Thanks to the division of the contact bar 19 into separate segments 29, any short circuit that occurs by accident is no more "transferred" to all the electrodes of the cells. It is actually transmitted only to the electrode in contact with the segment to which is connected the electrode that is at the origin of the trouble. Such not only reduces but avoids the risk of transmission of a short circuit to all electrodes, as it may occur with the existing contact bar made of one piece of constant diameter.

As aforesaid, the separate segments formed by the separating walls 17 with the central path could be sized to receive contact bars allowing connection of two, three or more adjacent anodes located in one of the adjacent cells, to two, three or more adjacent cathodes located in another one of adjacent cells, instead of connecting only one of them only to each other. As aforesaid, the only requirement is that all the electrodes of one cell be not in direct contact with all the electrodes of the adjacent cell.

The capping board 1 is preferably made from a plastic resin selected from the group consisting of polytetrafluoroethylene, acid resistant polyester, polyvinyl ester, epoxy, polyurethane, thermoset polyurethane and phenolic resins and blends thereof, and contains from 3 to 30% by weight of glass fibres, from 2 to 10% by weight of silica sand, from 1 to 30% by weight of mica, from 2 to 60% by weight of silica rocks, optionally from 2 to 40% a filler selected from the group consisting of clay, talc, calcium carbonate and magnesium oxide and optionally from 0.1 to 5% of fumed silica.

The capping board 1 may also comprise at least one embedded pultruded bar obtained by pultrusion of fibres selected from the group consisting of glass fibres, cizal fibres, resin fibres and carbon fibres, with a resin selected from the group consisting of polyester, vinyl ester, epoxy, polyurethane, thermoset urethane, bisphenol-expoxy A-F fumarate polyester series, acrylic and methacrylic, terephtalate polyester and phenolic resins and their mixtures. These pultruded bars may further coated with a surface layer of a resin bonding agent.

Preferably, more than one pultruded bars are embedded into the capping board 1. These bars are advantageously spaced-apart and arranged in a parallel relationship over the full length of the capping board.

Of course, minor modifications could be made to the contact bar disclosed hereinabove without departing from the scope of the invention as broadly disclosed in the summary of the invention and the appended claims.

The invention claimed is:

1. In a capping board for use to support hanging legs of anodes and cathodes within adjacent electrolytic cells, said capping board having a given length and comprising:

a main body having a bottom surface shaped to fit onto upper edges of said adjacent cells and a top surface;

a first set of spaced part insulating blocks projecting from said top surface, said first set of blocks extending in line all over the length of the capping board on one side of the main body; and a second set of spaced part insulating blocks projecting from said top surface, said second set of blocks extending also in line all over the length of the capping board at a given lateral distance from the first set of blocks;

said two sets of blocks forming two rows that together define a central path on said top surface;

each of said blocks having a recess forming an upwardly and laterally opening compartment to receive and support one of the hanging legs of said anodes and cathodes;

the improvement wherein said capping board also comprises:

a plurality of separating walls projecting upwardly from its top surface, said separating walls extending transversally across the central path and dividing said central path into a plurality of separate segments in which separate contact bars may respectively be positioned.

2. The improved capping board of claim 1, wherein the insulating blocks of the first set are in alternate position relative to those of the second one, whereby an anode or cathode having one leg held within a recess made on top of one of said insulating blocks on one side of a cell may have its opposite leg that extends between to adjacent insulating blocks of another identical capping board located on the other side of the cell and thus bears onto the separate contact bar positioned in the corresponding segment of the central path of said other identical capping board.

3. The improved capping board of claim 2, wherein each of said separate segment extends from one side of one of said blocks of one of said set of blocks to the same side of the next block of the same set of blocks, so as to allow electrical connection of the hanging legs of only one anode to one cathode.

4. The improved capping board of claim 2, wherein said board is made from a plastic resin selected from the group consisting of polytetrafluoroethylene, acid resistant polyester, polyvinyl ester, epoxy, polyurethane, thermoset polyurethane and phenolic resins and blends thereof, and contains from 3 to 30% by weight of glass fibres, from 2 to 10% by weight of silica sand, from 1 to 30% by weight of mica, from 2 to 60% by weight of silica rocks, optionally from 2 to 40% a filler selected from the group consisting of clay, talc, calcium carbonate and magnesium oxide and optionally from 0.1 to 5% of fumed silica.

5. The improved capping board of claim 4, wherein said board also comprises at least one embedded pultruded bar, each of said at least one pultruded bar being obtained by pultrusion of fibres selected from the group consisting of glass fibres, cizal fibres, resins fibres and carbon fibres, with a resin selected from the group consisting of polyester, vinyl ester, epoxy, polyurethane, thermoset urethane, bisphenol-epoxy A-F fumarate polyester series, acrylic and methacrylic, teerephtalate polyester and phonemic resins and their mixtures, said at least one pultruded bar being further coated with a surface layer of a resin bonding agent.

6. The capping board of claim 5, wherein more than one pultruded bars are embedded into said capping board, said bars being spaced-apart and arranged in a parallel relationship over the full length of said capping board.

7. A capping board according to claim 6, wherein the glass fibres of the capping board are in the form of a woven cloth or a pressed mat previously impregnated with said resin and mica, said cloth or mat being folded, rolled or brushed in layers so as to obtain the desired final shape and being re-impregnated with said resin and dusted with said silica sand and silica rocks during the folding, rolling or brushing process to ensure good adhesion between the layers.

8. The improved capping board of claim 7, wherein each of said separate segment extends from one side of one of said blocks of one of said set of blocks to the same side of the next block of the same set of blocks, so as to allow electrical connection of the hanging legs of only one anode to one cathode.

* * * * *